252-147 AU 166 EX
7/18/78 XR 4,101,437

United States Patent [19]
Rones et al.
[11] 4,101,437
[45] Jul. 18, 1978

[54] INHIBITOR FOR AQUEOUS ACID SOLUTIONS

[75] Inventors: Josef Rones; Joachim Geldner, both of Detusch, Fed. Rep. of Germany

[73] Assignee: Oxy Metal Industries Corporation, Warren, Mich.

[21] Appl. No.: 782,582

[22] Filed: Mar. 29, 1977

[30] Foreign Application Priority Data

Apr. 13, 1976 [DE] Fed. Rep. of Germany ..... 2616144

[51] Int. Cl.² ..... C11D 7/32; C11D 7/60
[52] U.S. Cl. ..... 252/149; 252/80; 252/82; 252/142; 252/146; 252/147; 252/180; 528/259
[58] Field of Search ..... 252/80, 82, 142, 146, 252/147, 149, 180, 136, 89; 210/58; 260/69 F, 68

[56] References Cited

U.S. PATENT DOCUMENTS 2,485,529 10/1949 Cordwell ..... 252/149
3,074,825 1/1963 Gordner ..... 252/149

FOREIGN PATENT DOCUMENTS 16,224 1963 Japan ..... 252/142

*Primary Examiner*—George F. Lesmes
*Assistant Examiner*—E. Rollins Buffalow
*Attorney, Agent, or Firm*—Arthur E. Kluegel; Bertram F. Claeboe; Richard P. Mueller

[57] ABSTRACT

Disclosed is a composition and process for inhibiting an aqueous acid solution and a composition so inhibited. The acid solution containing, for example, HF is inhibited by including a condensation product of a mixture of diethyl- and dibutyl-thiourea with hexamethylenetetramine.

6 Claims, No Drawings

INHIBITOR FOR AQUEOUS ACID SOLUTIONS

BACKGROUND OF THE INVENTION

The invention relates to an inhibitor as an additive for aqueous acid solutions, which is particularly suitable for hydrofluoric acid solutions and for pickling solutions and for cleaning pipelines and boiler parts made of steel and alloy steels.

In cleaning boiler installations, scale, rust and deposits must be removed with acid solutions, various inorganic and organic acids being used to this end, for example hydrochloric acid, sulphuric acid, amidosulphonic acid, citric acid, tartaric acid, or mixtures thereof. In recent times, solutions of hydrofluoric acid have been used successfully for this purpose. The concentration generally used is between 1 and 5% HF, with temperatures of up to 90° C. A pickling solution made on a hydrofluoric acid base dissolves iron oxides faster than other acids under the same conditions. The fluoride ions can easily be precipitated in the waste water as insoluble calcium fluoride, and thus eliminated. One major disadvantage of hydrofluoric acid, however, is that it attacks steel very heavily, especially high-alloy heat-resistant steels, the surfaces of which in installations must be cleaned without bringing about any changes in dimension (for example special valves). In addition to St 35,8 steels, the following materials are often involved: 15Mo3, Vl3CrMo44, 10CrMo9 10, X 2oCrMoV12 1, X 8 CrNiNb 1613, x35 CrMo 17, 13CrMo44, and others. Thus, if the base material is to be protected, appropriate inhibitors must be added to the acid solutions. Most so-called pickling inhibitors are organic substances, small quantities of which are added to the acid solution.

A series of very good pickling inhibitors has become available for pickling steel in the usual acids, for example sulphuric or hydrochloric acid. However, attempts to use these inhibitors in hydrofluoric acid also, especially in treating high-alloy steels, have failed to produce satisfactory results.

The main requirements for a good pickling inhibitor for use with hydrofluoric acid are as follows:

(a) it must act upon high-alloy steels even when used in small quantities. Most known inhibitors are useless for this purpose or must be used in large quantities;

(b) good solubility in the pickling solution — many pickling inhibitors have poor solubility and can therefore act only in low concentrations. They frequently float to the top in the solution, and settle onto the surfaces of the metal under treatment, from which they are hard to remove. This disadvantage may be observed in the usual thio-urea derivatives used as inhibitors, for example dibutyl- or ditoluyl-urea. Attempts are therefore often made to improve the solubility of pickling inhibitors by adding dissolving agents. However, these additives are not sufficiently effective and have other disadvantages, for example, they cause foaming;

(c) resistance to high temperatures — known inhibitors have the disadvantage of not being resistant to hydrofluoric acid solutions and of rapidly losing their effectiveness, especially at high temperatures;

(d) freedom from foaming — in the case of known inhibitors, this requirement is met only in exceptional cases. However, known non-foaming inhibitors have other disadvantages, for example poor solubility. Foaming is not detrimental to the pickling process itself, but raises difficulties in the processing of waste water. Foaming may be reduced to some extent by adding foam suppressants, but most of these are detrimental to waste water and their biological degradability is poor.

SUMMARY OF THE INVENTION

The inhibitor proposed, according to the invention, for aqueous acid solutions, especially for solutions containing hydrofluoric acid, and for cleaning pipes and boilers, consists of a condensation product of a mixture of diethyl- and dibutyl-thiourea with hexamethylene tetramine.

DETAILED DESCRIPTION OF THE INVENTION

This condensation product is preferably made by reacting a mixture of diethyl- and dibutyl-thiourea, in a weight ratio of from 1 : 5 to 5 : 1, with 0,1 to 1 mole of hexamethylene tetramine per mole of the thiourea mixture, at temperatures of from 100° to 150° C. It is possible to modify this by using other organic thiourea derivatives containing organic radicals (aliphatic or aromatic) having up to 10 carbon atoms, for example ditoluyl-thiourea, in addition to the mixture of diethyl- and dibutyl-thiourea, but the amount by weight of these other derivatives must not exceed 20% of the diethyl-dibutyl-thiourea mixture.

The inhibitor according to the invention is preferably dissolved in sulphuric acid in order to obtain the best properties for this technique. It is particularly advantageous to dissolve from 10 to 30% of the condensation product in 40 to 96% sulphuric acid.

The inhibitor proposed according to the invention has none of the above-mentioned disadvantages of known inhibitors. It also affords potection to high-alloy steels during treatment with hydrofluoric acid and, when mixed with sulphuric acid, it is easily soluble in water and acid. It is also satisfactorily resistant at high temperatures. The inhibitor operates completely without foaming.

Although the special advantages of the new inhibitor are to be observed mainly when it is used in hydrofluoric-acid solutions, it may, of course, also be used successfully in other acids, for example: sulphuric acid, hydrochloric acid, amidosulphonic acid, tartaric acid, oxalic acid, citric acid, or mixtures of several acids.

The inhibitor according to the invention may also be used in conjunction with known pickling inhibitors, if so desired.

The concentration of the inhibitor sufficient to inhibit attack by an aqueous acidic solution has no minimum or maximum value. Desired concentration depends on the type and strength of the solution to be inhibited and can readily be determined by simple experimentation. A concentration of 1 g/l of the condensation product was sufficient in the following Example The effectiveness of the inhibitors according to the invention is explained hereinafter in greater detail in comparison with other inhibitors.

EXAMPLE

The inhibiting value was measured gravimetrically. Degreased X 35 CrMo17 steel samples were immersed in a 1% hydrofluoric acid solution at 70° C for 4 hours. The reduction was determined by the difference in wieght before and after the treatment and was converted to $g/m^2h$. Samples in acid to which various pickling inhibitors had been added were tested in the same way.

The inhibiting value was determined according to the formula:

$$H = 100\,(G_1 - G_2/G_1)\%$$

wherein:

H = the inhibiting value $G_1$ = the weight loss in acid with no inhibitor $G_2$ = the weight loss in acid with an inhibitor.

Inhibitior compositions were prepared as follows:

(a)

40% by weight of dibutyl-thiourea (0,66 mole)

30% by weight of diethyl-thiourea(0,34 mole)

30% by weight of hexamethylene tetramine (0,36 mole).

The mixture was heated for 1 hour at 130° C. A 20% solution in 60% sulphuric acid was produced from the resulting condensation product.

The mixture is soluble in water and acids without clouding and is resistant to high temperatures.

(b)

70% dibutyl-thiourea (1 mole)

30% hexamethylene tetramine (0,32 mole)

Produced as in (a) above.

(c)

70% diethyl-thiourea (1 mole)

30% hexamethylene tetramine.

Produced as in (a) above.

A comparison of the properties of different pickling inhibitors during treatment of X 35 CrMo17 steel is given in the following table:

| Test No. | Inhibitor | Conc. g/l | Loss $g/m^2h$ | H % | Remarks |
|---|---|---|---|---|---|
| 1 | none | — | 450 | — | heavy attack |
| | Hexamethylene tetramine | 1 | 60 | 87 | considerable gas development |
| 3 | Dibutyl-thiourea | 2 | 20 | 95 | poor solubility spotty surface |
| 4 | Diethyl-thiourea | 1 | 50 | 88 | non-uniform attack |
| 5 | Inhibitor a) content 20% cond. product | 5 | 2 | 99,4 | almost no attack |
| 6 | Inhibitor b) | 5 | 8 | 98 | attack at edges |
| 7 | Inhibitor c) | 5 | 18 | 96 | distinct gas development |

What is claimed is:

1. An inhibitor for an aqueous acid solution consisting essentially of the condensation product of a mixture of diethyl- and dibutyl-thiourea with hexamethylenetetramine wherein the weight ratio of diethyl- to dibutyl-thiourea is from 1:5 to 5:1 and wherein the mole ratio of hexamethylenetetramine to thiourea mixture is from 0.1 to 1.1.

2. The inhibitor of claim 1 wherein the condensation is performed at temperatures of from 100° to 150° C.

3. The inhibitor of claim 1 comprising from 10 to 30 wt. % of the condensation product of claim 1 in 40 to 96 wt. % sulfuric acid.

4. The inhibitor of claim 1 further including as a reactant a third organic thiourea derivative containing organic radicals of up to 10 carbon atoms in an amount of up to 20 wt. % of the diethyl- dibutyl-thiourea mixture.

5. An inhibited aqueous acidic solution comprising the product of claim 1 and at least one acid selected from the group consisting of hydrofluoric, hydrochloric, sulphuric, amidosulphonic, citric, tartaric and oxalic acids.

6. A process for inhibiting the attack of an aqueous acid solution comprising adding to the solution the product of claim 1.

* * * * *